US012790914B2

(12) United States Patent
Bailey et al.

(10) Patent No.: US 12,790,914 B2
(45) Date of Patent: Nov. 10, 2026

(54) METHOD TO MITIGATE WELLBORE INSTABILITIES

(71) Applicant: Schlumberger Technology Corporation, Sugar Land, TX (US)

(72) Inventors: William J. Bailey, Cambridge, MA (US); Kashif Rashid, Cambridge, MA (US); Florian Hollaender, Cambridge, MA (US); Bertrand Claude Emile Theuveny, Paris (FR)

(73) Assignee: Schlumberger Technology Corporation

( * ) Notice: Subject to any disclaimer, the term of this patent is extended or adjusted under 35 U.S.C. 154(b) by 0 days.

(21) Appl. No.: 19/240,793

(22) Filed: Jun. 17, 2025

(65) Prior Publication Data

US 2025/0382854 A1 Dec. 18, 2025

Related U.S. Application Data

(60) Provisional application No. 63/660,867, filed on Jun. 17, 2024.

(51) Int. Cl.

| | |
|---|---|
| ***E21B 34/08*** | (2006.01) |
| ***E21B 33/124*** | (2006.01) |
| ***E21B 41/00*** | (2006.01) |
| ***E21B 47/047*** | (2012.01) |
| *E21B 34/10* | (2006.01) |
| *E21B 34/16* | (2006.01) |
| *E21B 43/38* | (2006.01) |

(52) U.S. Cl.

CPC ..... *E21B 34/08* (2013.01); *E21B 33/124* (2013.01); *E21B 41/0057* (2013.01); *E21B 47/047* (2020.05); *E21B 34/10* (2013.01); *E21B 34/16* (2013.01); *E21B 43/385* (2013.01); *E21B 2200/02* (2020.05)

(58) Field of Classification Search

None

See application file for complete search history.

(56) References Cited

U.S. PATENT DOCUMENTS 2,880,959 A * 4/1959 Falconer ..... F16K 1/38 251/35
3,123,094 A * 3/1964 Toschokoff ..... F16K 31/365 137/505.3
3,344,805 A * 10/1967 Wapner ..... G05D 16/0655 137/486
4,691,778 A * 9/1987 Pyne ..... E21B 34/10 137/538

(Continued)

FOREIGN PATENT DOCUMENTS

WO 2022115758 A1 6/2022

OTHER PUBLICATIONS

Tang, H. et al., "A Unified Gas/Liquid Drift Flux Model for All Wellbore Inclinations", SPE Journal, SPE-197068-PA, Jun. 12, 2019, pp. 1-18.

*Primary Examiner* — Blake Michener

(57) ABSTRACT

Aspects of the disclosure provide a method of mitigating liquid instability in controlled intra-well cross-flow between two, or more, zones accessed by a well. One or more embodiments define new functionalities necessary for dynamic multiphase flow (MPF) simulation to model, mitigate and control liquid instability observed in a well.

14 Claims, 10 Drawing Sheets

(56) References Cited

U.S. PATENT DOCUMENTS

| | | | | |
|---|---|---|---|---|
| 5,265,643 | A * | 11/1993 | Golestan | G05D 7/0133 137/504 |
| 5,335,732 | A * | 8/1994 | McIntyre | E21B 33/124 166/387 |
| 5,383,489 | A * | 1/1995 | Golestan | G05D 7/0133 137/504 |
| 6,289,990 | B1 * | 9/2001 | Dillon | F16K 17/19 166/373 |
| 6,543,540 | B2 | 4/2003 | Woie | |
| 6,786,285 | B2 * | 9/2004 | Johnson | E21B 43/32 166/250.15 |
| 7,708,074 | B2 * | 5/2010 | AlMubarak | E21B 34/08 166/334.1 |
| 8,820,413 | B2 * | 9/2014 | Mathiesen | E21B 34/08 251/282 |
| 11,680,464 | B2 | 6/2023 | Bailey | |
| 12,523,123 | B2 * | 1/2026 | Shakeel | E21B 41/0035 |
| 2001/0050170 | A1 * | 12/2001 | Woie | E21B 49/008 166/250.07 |
| 2008/0149349 | A1 | 6/2008 | Hiron | |
| 2011/0011590 | A1 * | 1/2011 | Mathiesen | E21B 43/162 166/305.1 |
| 2011/0056578 | A1 * | 3/2011 | Mathiesen | F16K 15/02 138/46 |
| 2011/0067878 | A1 * | 3/2011 | Aadnoy | E21B 43/12 166/321 |
| 2016/0102548 | A1 | 4/2016 | Kuchuk | |
| 2017/0342803 | A1 * | 11/2017 | Clement | E21B 34/06 |
| 2023/0243330 | A1 | 8/2023 | Rasmussen | |

* cited by examiner $$\Delta p_c = C_u \frac{\rho_m \left[\frac{Q_m}{A_c}\right]^2}{2C_v^2}$$

| | |
|---|---|
| $A_c$ | Area of valve constriction [m$^2$] |
| $C_u$ | Units conversion constant |
| $C_v$ | Dimensionless coefficient of valve [–] |
| $Q_m$ | Mixture flow rate [m$^3$/s] |
| $\Delta p_c$ | Pressure drop over constriction [Bar] |
| $\rho_m$ | Mixture density [kg/m$^3$] |

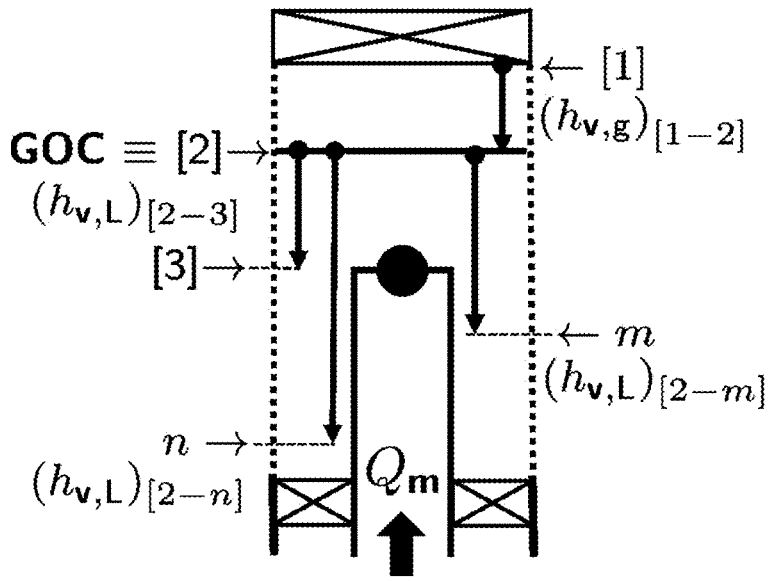

FIG. 10

$$(p_{\mathrm{h},p})_x = \rho_p\, g\, (h_{\mathbf{v},p})_x$$

| | |
|---|---|
| $(p_{\mathrm{h},p})_x$ | Hydrostatic pressure of phase $p$ at location $x$ [Bar] |
| $g$ | Gravitional constant [m/s$^2$] |
| $(h_{\mathbf{v},p})_x$ | Vertical height of phase $p$ at location $x$ [m] |
| $\rho_p$ | Density of fluid phase $p$ [kg/m$^3$] |

$$\Delta p_{\mathbf{c}} = C_u \frac{\rho_{\mathbf{m}} \left[\dfrac{Q_{\mathbf{m}}}{A_{\mathbf{c}}}\right]^2}{2\, C_v^2}$$

| | |
|---|---|
| $A_{\mathbf{c}}$ | Area of valve constriction [m$^2$] |
| $C_u$ | Units conversion constant |
| $C_v$ | Dimensionless coefficient of valve [−] |
| $Q_{\mathbf{m}}$ | Mixture flow rate [m$^3$/s] |
| $\Delta p_{\mathbf{c}}$ | Pressure drop over constriction [Bar] |
| $\rho_{\mathbf{m}}$ | Mixture density [kg/m$^3$] |

FIG. 11

METHOD TO MITIGATE WELLBORE INSTABILITIES

CROSS-REFERENCE TO RELATED APPLICATIONS

The present application claims priority to U.S. Provisional Patent Application 63/660,867, filed Jun. 17, 2024, the entirety of which is incorporated herein by reference.

FIELD OF THE DISCLOSURE

Aspects of the disclosure relate to mitigation of liquid flow instability. More specifically, aspects of the disclosure relate to mitigating liquid flow instability in controlled intra-well cross-flow between two, or more zones accessed by a well.

BACKGROUND INFORMATION

Wellbore flow instabilities pose significant challenges in hydrocarbon production, as they can lead to disruptions in fluid flow, reduced efficiency, and potential environmental hazards. These instabilities often arise from uncontrolled liquid cross-flows between zones within the wellbore, causing erratic fluid dynamics that hinder the predictable operation of production systems. Avoiding such instabilities is crucial for maintaining optimal well performance, ensuring the integrity of the wellbore, and minimizing operational risks. Effective management of these instabilities, through innovative mechanical or autonomous systems, contributes to enhanced injectivity and supports the goal of achieving cleaner, more sustainable extraction processes.

There is a need to provision a method of field operation that allows for wellbore instabilities but yet maximizes the economic value of the field. There is a further need to provide a method that will control fluids inflow to an injection area based upon hydraulic head available. There is a still further need for devices to carry out such functions.

SUMMARY

Described herein is a mechanical choke system (sleeve/valve/port) where the degree of opening is automatically adjusted as a function of the (vertical) height of the liquid level above the device.

In one example embodiment, a method to mitigate wellbore instabilities is disclosed. The method may comprise determining a presence, in a first portion of a wellbore, of a production zone. The method may further comprise establishing an injection zone in a second portion of the wellbore. The method may further comprise cross-connecting the production zone and the injection zone through use of a production tubing that may contain a choke (or other flow control device) and/or a flowmeter. The method may further comprise achieving a natural flow from the production zone to the injection zone through the production tubing, wherein a first end of the production tubing is placed in relation to the second end, such that a hydrostatic head of a liquid phase is sufficient to open and close a pressure arrangement. The method may further comprise monitoring the flow of fluids between the cross-connected production zone and the injection zone. The method may further comprise continually identifying a prevailing liquid column within the injection zone. The method may further comprise actuating the choke based upon the monitoring of the flow of fluids between the cross-connected production zone and the injection zone to reduce wellbore instabilities, the actuation taking into account the prevailing liquid column within the injection zone.

In one example embodiment, a method for controlling a volume in an injection zone of a hydrocarbon field is disclosed. The method may comprise cross-connecting a production zone and an injection zone and achieving a natural flow from the production zone to the injection zone through the cross-connection of the production zone and the injection zone via a production tubing; such that a hydrostatic head of a liquid phase is sufficient to open and close a pressure arrangement placed within the cross-connection. The method may further comprise actuating a choke (sleeve/valve/port) in the cross-connection based upon the head.

In another example embodiment, a device for varying flow in a wellbore is disclosed. The device may comprise a pipe having a first fluid receiving end and a second ejecting end. The device may also comprise a valve configured to open and close positioned at the second ejecting end. The device may also comprise a restriction arrangement connected to the valve at the second ejecting end of the pipe, wherein the arrangement is configured to autonomously control a position of the valve based upon a liquid level height above the second ejecting end.

Another embodiment relates to a method for specifying one or more annular volumes (located in the lower part of the injection zone) which are isolated from each other by annular packers. Connect each of these volumes to the production string by dedicated ports which can be made to open autonomously as a function of the hydrostatic head or remotely as necessary. The opening of the ports to these additional annular spaces allows liquid to enter the unused volume and then flow into the injection zone as there is sufficient pressure differential (a condition imposed on the port to open). The port is then closed autonomously (as hydrostatic head is insufficient to keep it open) or closed remotely. An array (ensemble) of such volumes can be specified to have greater flexibility to reduce (dampen, mitigate) liquid instability in the injection zone.

In one or more embodiments, a device that is located in the injection zone which varies (adjusts) flow into the annular space across the zone by the hydrostatic head of the vertical liquid column above it. If liquid level becomes high (i.e., small gas cap indicated by the gas-oil-contact (GOC) rises to the top of the zone) then the device (sleeve or port) will close, thereby reducing inflow and allowing the liquid to flow from the annular space into the injection zone.

Conversely, if liquid level drops (i.e., the GOC falls to bottom of injection zone) then it will autonomously open with reduced pressure drop, thereby causing more liquid hydrocarbons to enter the injection zone. Thus, causing the liquid level to rise accordingly in the annular space across the injection zone.

By judicious balancing of downhole choke, rate measurement, and careful design of the degree of valve (port) orifice size as a function of overlying liquid level, it is intended that liquid level instabilities may be effectively managed. Such instability is not desirable as it reduces injectivity and thus, effectiveness of the cross-flow operations.

In one or more embodiments, a method of modifications to dynamic multiphase flow (MPF) simulation in order to model, suppress and mitigate liquid instability for the purpose of zero emission clean-up simulation is proposed.

In one or more embodiments, a method for providing the capability and flexibility in a dynamic MPF simulator to reduce (dampen, mitigate) liquid instability in the injection zone for the purpose of accurate modeling of cross-flow operations. The method provides the ability to explicitly model a closed system with fluid phase-specific hydrostatic head-controlled valves and ports.

BRIEF DESCRIPTION OF THE FIGURES

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are; therefore, not be considered limiting of its scope, for the disclosure may admit to other equally effective embodiments. To facilitate understanding, identical reference numerals have been used, where possible, to designate identical elements that are common to the figures ("FIGS"). It is contemplated that elements disclosed in one embodiment may be beneficially utilized on other embodiments without specific recitation.

FIG. 10 illustrates vertical heights of both liquid and gas phases; and

FIG. 11 are examples of key expressions that are necessary to be modeled in a dynamic MPF simulator.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. It will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal, or slanted relative to the surface.

Figure 1:
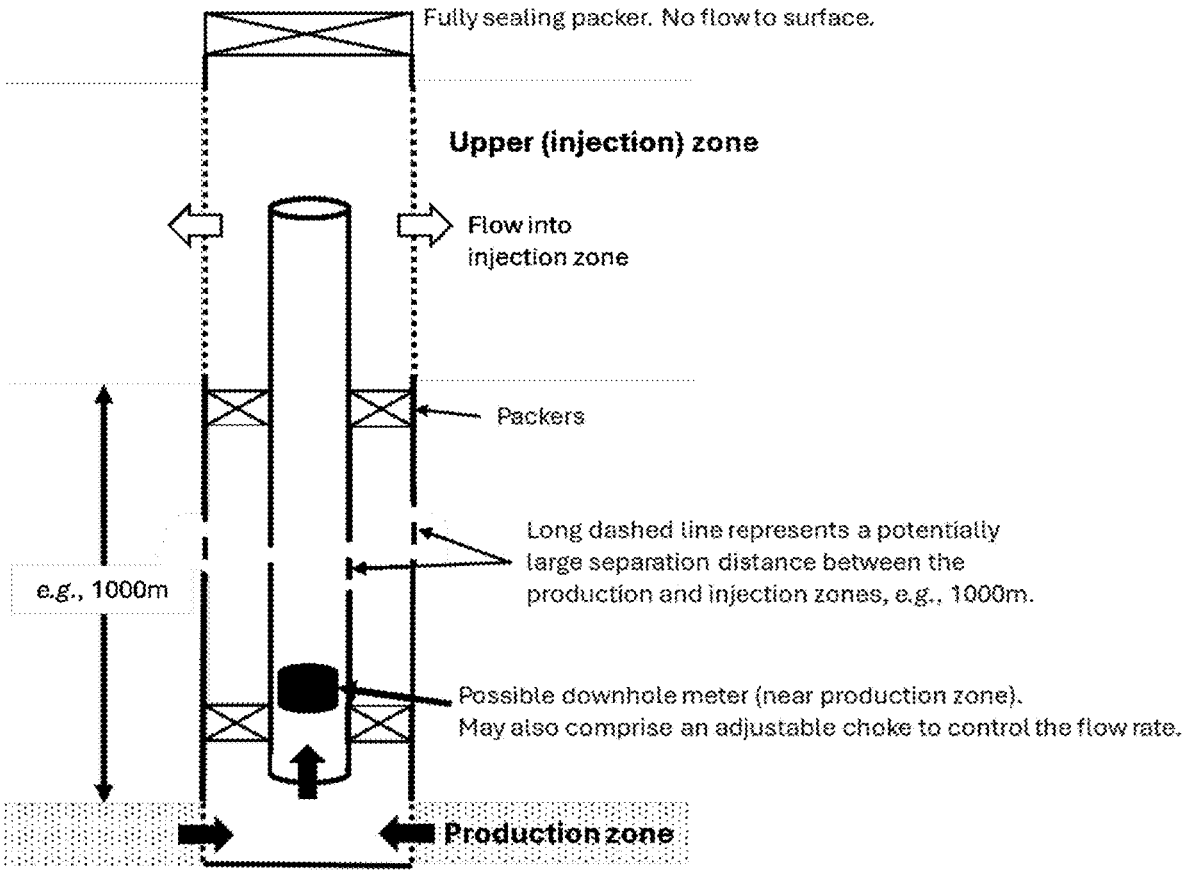
FIG. 1 depicts a basic flowing system with cross-flow between a lower production zone and an upper injection zone.

Aspects of the disclosure describe an autonomous or remotely controlled sleeve or cap that open or close a constriction valve to increase or decrease the pressure drop, thereby enabling or hindering gas liberation. The opening and closing may be performed over a continuous range. These actuations are performed within the framework of a setup where flow between two sub-surface geological formations under hydrodynamic un-equilibrium is occurring within a wellbore. In this embodiment each interval is isolated by means of packer assemblies and communication established through a connecting tubing (FIG. 1). The intent of the valve is to manage the gas-oil contact and thus, pressure and injection profile within the wellbore, thereby stabilizing the flow into the injection zone.

FIG. 1 illustrates an example of a cross-flow system used to demonstrate the concepts of this disclosure. The flowing system is essentially isolated in that no flow of wellbore fluid reaches the surface. The system comprises a (lower) production zone and an (upper) injection zone some distance higher up in the well. In this example, it is assumed the bottom of the injection zone is about 1000 m [total vertical depth] above the top of the production zone. In practice, the distance is sufficient so that an adequate hydrostatic pressure difference exists to achieve measurable natural flow of wellbore fluids from the lower production zone towards the upper injection zone and that the required downhole tool assembly can be deployed in the available wellbore length. Packers isolate these zones, and a production tubing connects one zone to the other. The tubing exits into the injection zone at a point such that the hydrostatic head (of the liquid phase of the wellbore fluid) is sufficient to either fully open and fully close the choke, sleeve, cap, and/or valve (arrangement)—be it autonomously or remotely controlled via hydraulic or electric cabling.

FIG. 1 shows the schema of the basic flowing system with cross-flow of wellbore fluids between a lower production zone and an upper injection zone. The zones are isolated by packers but are connected via a production tubing string. A choke and/or a flowmeter can be located in the production string, in which the choke may be remotely actuated to control inflow of wellbore fluids into the production tubing string. The system assumes a 1000 m vertical distance between the top of the production zone and the bottom of the injection zone but is used as an example only. Any distance is possible as the production and injection zones are dictated by in situ geology and the well completion type. Lastly, as illustrated by the large packer above the injection zone, there is no flow to the surface.

Figure 2:
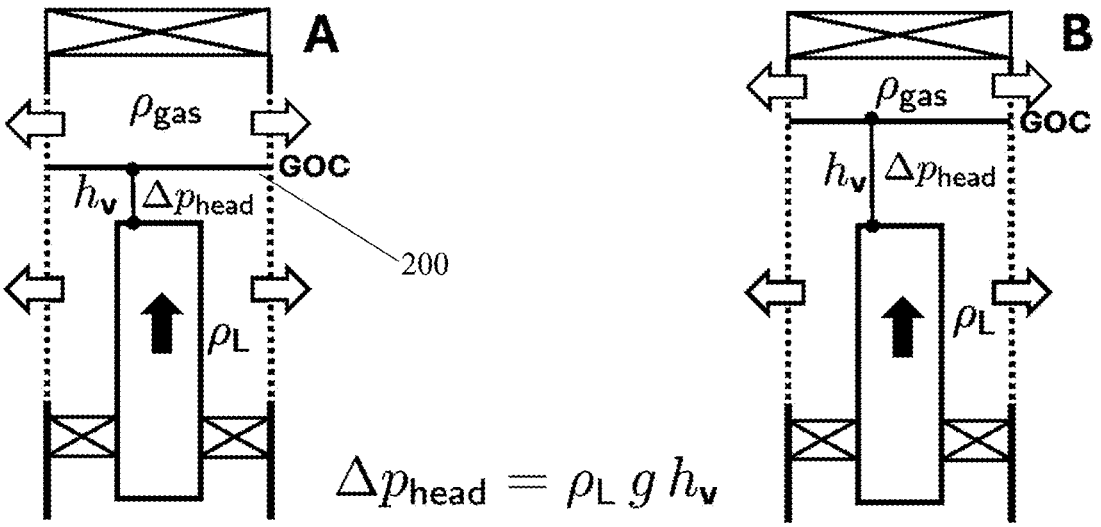
FIG. 2 is an illustration of the outlet section of production tubing adjacent to the injection zone with liquid levels (denoted by the gas-oil contact GOC level)

FIG. 2 shows an enlargement of the injection zone (from FIG. 1) for two particular cases (labelled A and B) with differing wellbore fluid liquid height level. As produced hydrocarbons (wellbore fluids) experience a loss of pressure due to the combination of flow-induced drawdown in the producing interval and gravity-driven pressure losses in the fluid column, it is likely that in many instances, the produced oil will cross below its saturation pressure and that gas bubbles will come out of the solution. Due to buoyancy, the gas from the wellbore fluid will segregate and accumulate below the upper sealing packer. The separated liquid and gas phases of the wellbore fluid are noted by the gas-oil contact (GOC) given by line 200. The vertical distance from the GOC line to the location of the autonomous control valve or choke is marked as hv. In this FIG. 2, it is assumed that the valve or choke is located at the top of the outlet pipe; however this disclosure accepts that while the baseline for hydrostatic head should be at this level, the valve or choke itself can be as near to the top of the pipe as the completion permits and as operational design recommends. Further variants of the disclosure consider the possibility of a stacked series of such valves or chokes which may prove necessary to stabilize excessive liquid level instability over a much larger vertical extent. Thus, the concept is not limited or restricted to one location.

FIG. 2 also shows the basic expression for hydrostatic head. This is a function of liquid phase density, gravity constant and vertical height of the liquid column above the device/valve level. Sub-FIG. A (left) illustrates a relatively low liquid level above the device. Sub-FIG. B (right) illustrates a relatively high liquid column above the device. In each case the value of hydrostatic head is different according to the stated expression. Note that liquid density is assumed known from fluid sample testing.

FIG. 2 is an illustration of the outlet section of production tubing adjacent to the injection zone with liquid levels (denoted by the gas-oil contact GOC level). Sub-FIG. A (left) shows a relatively low liquid level with respect to the outlet of the production tubing. This is the assumed location of the device which is described in greater detail in FIG. 3. Sub-FIG. B (right) shows a higher liquid level resulting in a greater pressure change. The expression given is to calculate the hydrostatic head as function of the liquid density, gravity, and the vertical height of the liquid column.

It can be demonstrated, either under some simplifying assumptions, or using a more detailed coupled modeling that considers producing and receiving zones properties along with fluid phase behavior, that the achievable flow rate is quite strongly dependent on the GOC in the upper section. This defines the relative size/height of the injection zone ready to receive the separated liquid and gas volumes respectively and, as a consequence, impacts the overall production/injection system potential.

It may be demonstrated that a relation exists of the form:

$$(P_{A,0} - P_{B,0}) - \bar{\rho} g \Delta h_{A-B} = \int_0^t q_A(\tau) \cdot \left( g_A(t-\tau) + \left( \frac{h_{liq}}{h_{tot}} \right)_B g_{inj}(t-\tau) \right) d\tau. \quad \text{Eq. 1}$$

Where $P_{A,0}$ and $P_{B,0}$ are the initial formation pressure in the lower and upper formations respectively, $\bar{\rho}$ is the average fluid density in the flowing column, $\Delta h_{A-B}$ is the true vertical depth difference between selected reference points in each interval, $q_A(t)$ is the production rate from the lower zone over time, $g_A(t)$ the impulse response (response to a Dirac pulse) of the producing zone, $g_{inj}(t)$ the impulse response of the oil-gas receiving upper reservoir system, and $$\left( \frac{h_{liq}}{h_{tot}} \right)_B$$

is the liquid column height over the total receiving interval thickness.

Eq. 1 highlights the existence of a relationship between liquid level and flow-rate/flowing pressure. The left-hand side of the equation is essentially a fixed flow potential, equal to the initial pressure difference between layers minus the fluid hydrostatic head. The liquid level is the main adjustment variable.

Controlling this interface is not straightforward, because the flowing and injection pressures will evolve over time leading to variable conditions, potentially making subsequent data analysis complex. Additionally, controlling the interface may be challenging because the evolution of gas bubbles in the tubing will lead to multiphase flow conditions that can evolve into churn or slug flow regimes over time, leading to rapid variations at the tubing outlet. This produces rapid level changes with associated pressure and rate instabilities.

Not only do these instabilities affect the data analysis process, but associated pressure/flow shocks may cause gradual wear and tear on downhole tools, ultimately leading to damage or failure of the equipment. As a consequence, a method to control flow and reduce its instability becomes desirable.

Figure 3:
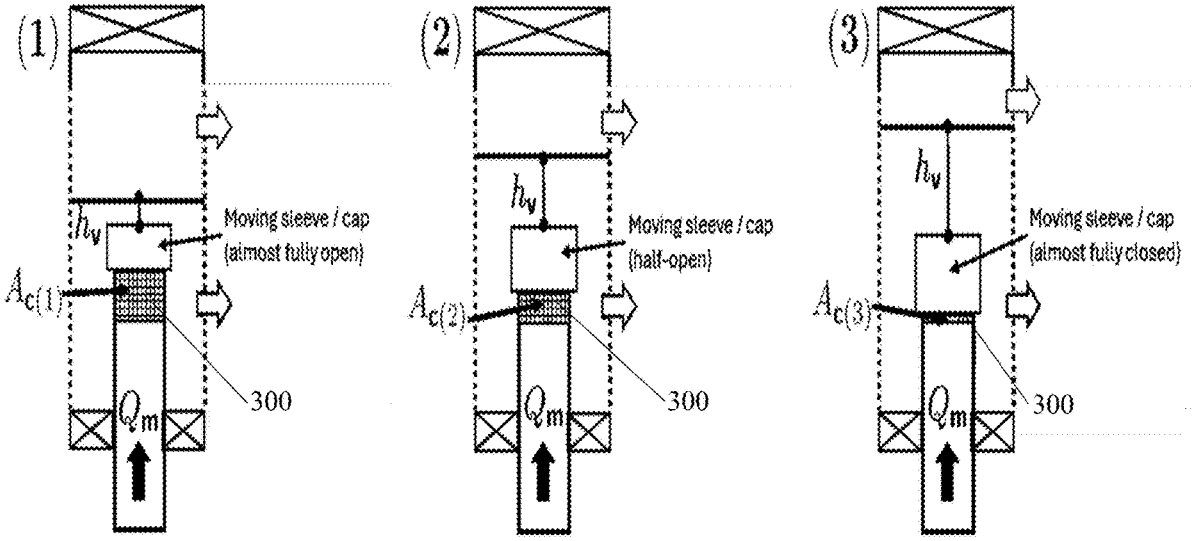
FIG. 3 illustrates three example conditions of a possible inflow control device.

FIG. 3 illustrates a schematic of the outlet device under 3 different scenarios of liquid height (low, medium, and high). The "device" is shown here as a restriction arrangement (movable cap or sleeve) that covers-up or opens-up a valve or set of valves (shown as a hatched region 300). The exposed area of this outlet is shown as a function of the prevailing vertical liquid height above it. The mixture flow rate ($Q_m$) is known. The sleeve or valve can; therefore, be made to autonomously adjust itself with respect to the prevailing liquid column above it. Aspects of the disclosure allow the ability to directly control this device through electric or hydraulic means if deemed appropriate or necessary.

If the mixture flowrate in the production string is known, the area of the valve constriction which is open to flow may be deduced by the location of the sleeve/device/cap. The resultant constriction pressure loss across the valve(s) is shown by the expression given in FIG. 3. The dimensionless flow coefficient of the valve ($C_v$) from experimental vendor data and the mixture density from fluid samples or direct downhole measurements are known.

If the liquid level is low ($h_v$ is small)—sub-FIG. (1) in FIG. 3—the device opens up, thereby reducing the pressure drop across the valve. This will promote more liquid to enter the volume of the pipe adjacent the injection zone. There will be some gas-liquid separation, but only in the upper reaches of the subtended volume. This will result in a higher liquid phase content in the volume that will help to reduce instability.

If liquid level is medium ($h_v$ is medium)—sub-FIG. (2) in FIG. 3—the device closes slightly, thereby increasing the pressure drop across the constriction with the result of enabling increased gas liberation. Ultimately, a balance is established between liquid and gas liberation volumes so that a stable gas-liquid interface is induced and retained. As a consequence, this permits constant flow into the injection zone.

If liquid level is high ($h_v$ is large)—sub-FIG. (3) in FIG. 3—the device closes, and the resultant constriction pressure loss becomes large. This large pressure drop will slow down inflow favoring gas separation and slippage in the tubing as well as liberate more gas which will rise to the top of the subtended volume. In time, this will reduce the liquid phase vertical height to a stable position while stabilizing injection.

Three examples of the proposed "device" are presented in FIG. 3. Here, the device is represented as a sleeve or cap which opens or closes the exit port (valve) as a function of the liquid column above it. The resultant constriction loss will cause either more or less gas to be liberated, thus increasing or decreasing the liquid column height. Thus, this will help stabilize the flow into the injection zone if the GOC is held at a suitable level by design.

Figure 4:
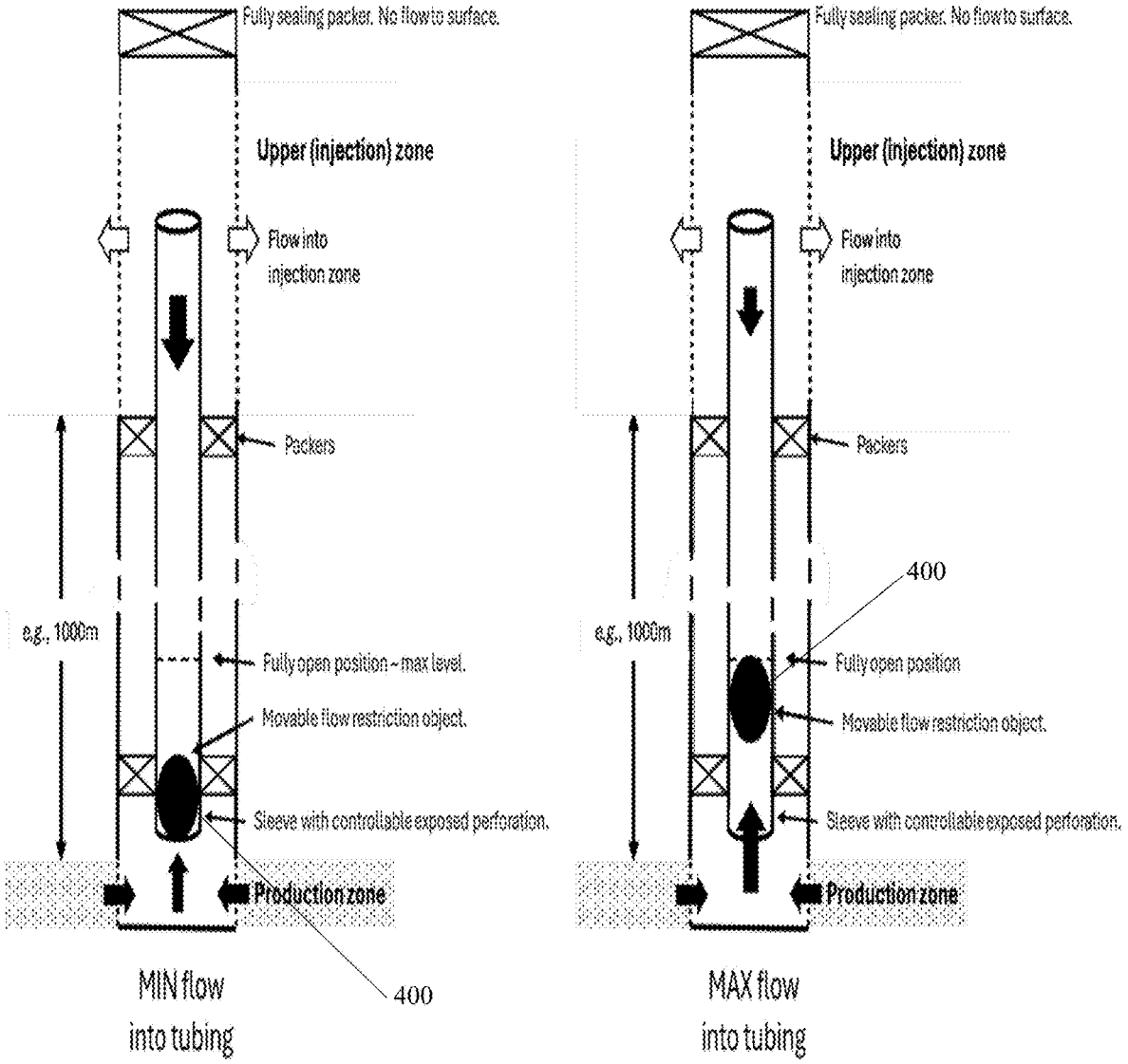
FIG. 4 is a schematic of an autonomous pressure-controlled device.

FIG. 4 shows a further embodiment that serves to permit autonomous flowrate management given the pressure differential across the two zones. When the height of liquid column is large (left plot), the pressure exerted will force a movable flow restriction object of known weight to its lowest level. This is akin to the near closed position yielding the minimum flow rate into the tubing. Conversely, when the liquid column is small (right plot), the pressure differential is small and the flow restriction object can move upwards yielding the fully open position. If the perforation or open spacing can be controlled on the sleeve, the two schemes permit autonomous flow management. Thus controlling the stable GOC level in the upper zone around some operating band such that the injection into the formation remains stable.

An additional benefit of having a flow restriction at the tubing intake is that, by generating a pressure drop at the bottom of the tubing, the fluid may go below saturation pressure from the bottom of the well and with sufficient gas holdup, the overall flow velocity is increased by gas expansion. Higher velocities, better lift, and more stable flow conditions less prone to slugging and subsequent flow and pressure instabilities are generated. Several mechanisms can be considered to adapt automatically flow behavior with restriction mechanisms opening at high velocities, including sleeves or balls, for instance.

A schematic of an autonomous pressure-controlled device is shown in FIG. 4. The central column comprises a series for pre-defined perforations and the flow restriction object 400 in the center will rise and fall based on the pressure difference observed between the two sides. Thus, if the liquid column above is large, the high pressure will force the ball to fall to a near-closed position. Conversely, when the liquid column is small, the low pressure will allow the ball to rise to a near-open position. In this manner, the device can manage the flow rate given pressure differential observed. Indeed, changing the perforation (opening) on the sleeve will potentially permit a stable flow regime to be achieved by design.

Another aspect of the disclosure presents the concept of redundant annular volume space, defined as a series of annular volumes separated by isolation packers, that surround the production tubing connecting a lower production zone to an upper injection zone. Each of these annular volumes may comprise different sizes and are accessed by a dedicated port that may be autonomously actuated as a function of hydrostatic head (due to the liquid column) or be operated remotely by need. The purpose of these volumes is to provide flexibility to redirect flow to reduce or dampen liquid level instability above in the injection zone. Once a port is opened to the annular space, there will be sufficient pressure differential between fluid filling the volume and the injector such that the fluid will flow into the injection zone. The opening and closing of one, or more, of these ports will provide the necessary volumetric flexibility to control (dampen) any liquid instability (anticipated in the gas-oil contact, GOC) in the main volume adjacent to the injection zone.

Figure 5:
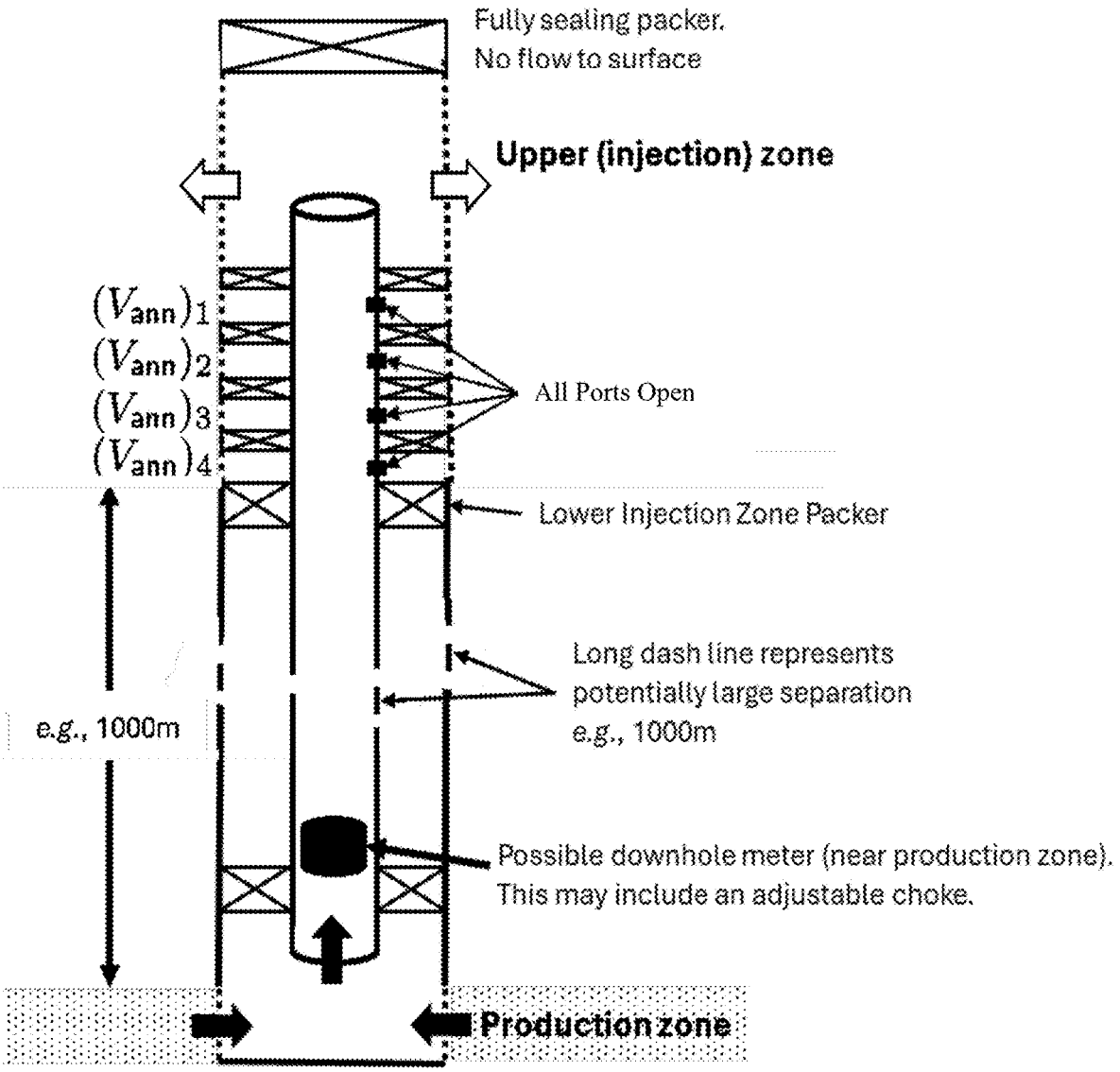
FIG. 5 illustrates the concept of the intended system with cross-flow between a lower production zone and an upper injection zone with multiple annular volumes used to dampen flow instabilities.

FIG. 5 illustrates an example of the intended system that exhibits the cross-flow being promoted. The flowing system is isolated in that no flow reaches surface. The system comprises a (lower) production zone and an (upper) injection zone that is at a higher distance in the well. In this example, it is assumed that the bottom of the injection zone is about 1000 m [total vertical depth] above the production zone. Packers isolate the production and injection zones that are effectively connected via a production tubing. In this example, four annular volumes are denoted $(V_{ann})_{1\text{-}4}$ and their associated dedicated ports are noted as open or closed. Thus, these ports can be made to open autonomously (as a function of the hydrostatic head of liquid column adjacent them or as a function of the differential pressure between tubing and annulus) or they may be opened/closed remotely via hydraulic or electric cabling. This arrangement has the effect of changing the volume available for the produced fluid as needed to manage the observed liquid instability.

The arrangement may temporarily increase the intake capacity of the receiving zone, by increasing the total mobility of the injection zone, thus reducing the average injection pressure. This temporary boost may activate only as required when the flowing pressure across the buffer interval exceeds a pre-defined flowing pressure limit, indicative of a reducing drawdown and thus, rate from the producing interval. This increase in injectivity may help compensate for a reduction in production as the producing reservoir depletes or sees its productivity reduced by flow boundaries, but also for possible injectivity decrease caused by fines migration or other causes.

Figure 6:
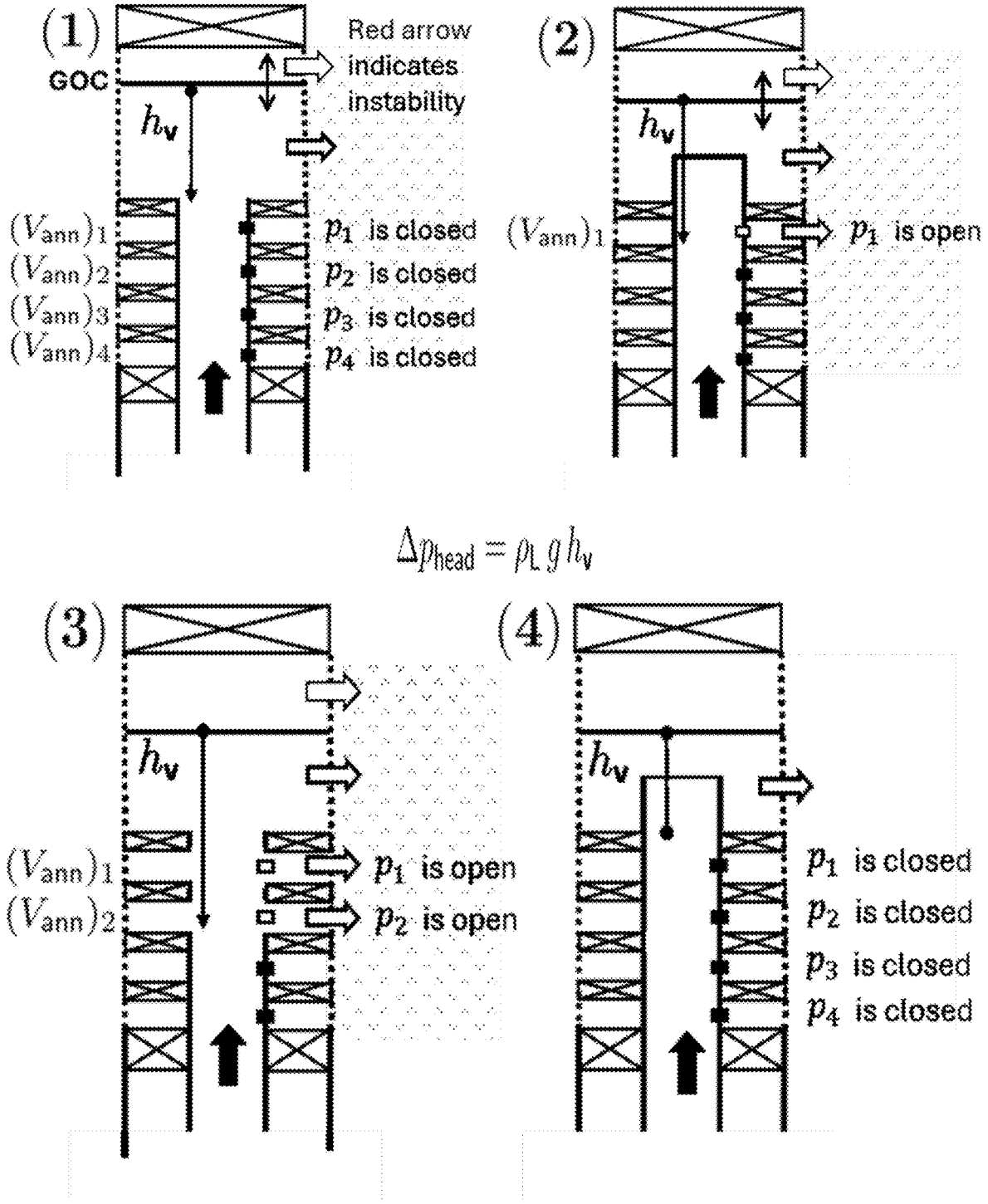
FIG. 6 presents a series of sub-FIGS that illustrate the intended concept. In the first sub-FIG., all the ports are closed. In the second sub-FIG., port 1 is open that allows production fluid to enter the annular volume released. In sub-FIG. 3, port 2 is also open. In sub-FIG. 4, the ports return to the closed state after mitigating the noted liquid instability. The annular volumes are labelled (Vann) 1-4 with associated ports, p1-4. These volumes can all be different in size, or the same, depending on the in situ geology and well completion.

FIG. 6 illustrates a schematic of a proposed arrangement in operation. The four annular volumes labelled $(V_{ann})_{1\text{-}4}$ along with their associated ports $(p_{1\text{-}4})$ are shown. The expression for hydrostatic head is also noted. The four sub-FIGS. serve to illustrate the operation to manage liquid instability and are described in further detail below. Notably, an open port that permits production fluid to flow into the annular region is marked, while a closed port is also indicated. The vertical liquid height (indicative of the hydrostatic head) is denoted by $h_v$.

The four sub-FIGS. are described as follows:

(1) The gas-oil contact (GOC) is close to the top of the injection zone. The double-headed arrow denotes identification of liquid level instability. The initial hydrostatic head is shown by the arrow extending from the GOC to a level above the first annular zone. Gas and liquid flows into an injection zone are marked by arrows, respectively.

(2) The liquid instability persists. The hydrostatic head adjacent p1 (the port associated with volume 1) is sufficient to autonomously open the port, which is illustrated by a square. Liquid flows into this volume.

As there is sufficient pressure differential (a condition on the port opening) the liquid will flow into the formation (marked by the arrow).

(3) The GOC has dropped, but the liquid level instability initially persists. To this end, the hydrostatic head adjacent volume 2 results in port 2 opening (either autonomously or remotely). The open port is again represented by a square. Liquid flows into the volume (Vann)2 and into the injection zone. The new GOC equilibrium is established and the liquid instability is no longer discernible.

(4) The new equilibrium liquid level is sufficient for ports 1 and 2 to close (denoted as squares) and the system is stabilized as per intent.

In the preceding example, the annular volumes 3 and 4 were not used. It is possible; however, that the degree of instability encountered may have required the additional volume to relieve the liquid level in the same manner as the annular volumes 1 and 2. The presence of this array (ensemble) of separated annular volumes, with dedicated ports that can be designed to open at specific levels of hydrostatic head or remotely by need, provides the system with sufficient volumetric redundancy to manage severe liquid level instabilities as well as flexibility to manage initial design uncertainties. This automated control can help not only smooth down the flow response by dampening changes but also help manage flow conditions towards target flowing pressure, thus making operations preparations more resilient to unexpected formation response.

The system may contain both a hydrostatic control based on the pressure between the top of the formation and the set of valves, and an opportunity to use tubing pressure as a control, enabling flow towards shallower interval only when those have reached pressure ensuring that the formation would indeed be able to receive fluids, i.e. when the packed-off receiving zone shows a pressure lower than tubing flowing pressure at the target depth.

In action, the process relieves excess liquid in the main injection zone by opening hitherto unused annular volumes. The distance separating and delineating each volume may be different for each situation and may comprise a height of a few meters in length to hundreds of meters, as warranted by design targets and formation prognosis in terms of initial pressure and injectivity. The size of these volumes is a design variable for the completions and fluids engineer. The pressure at which the port(s) will autonomously open and close can also be specified and designed beforehand. These may be over-ridden; however, by manual (or automated) remote operation, subject to suitable metering (specifically an array of pressure gauges in the injection zone).

Figure 7:
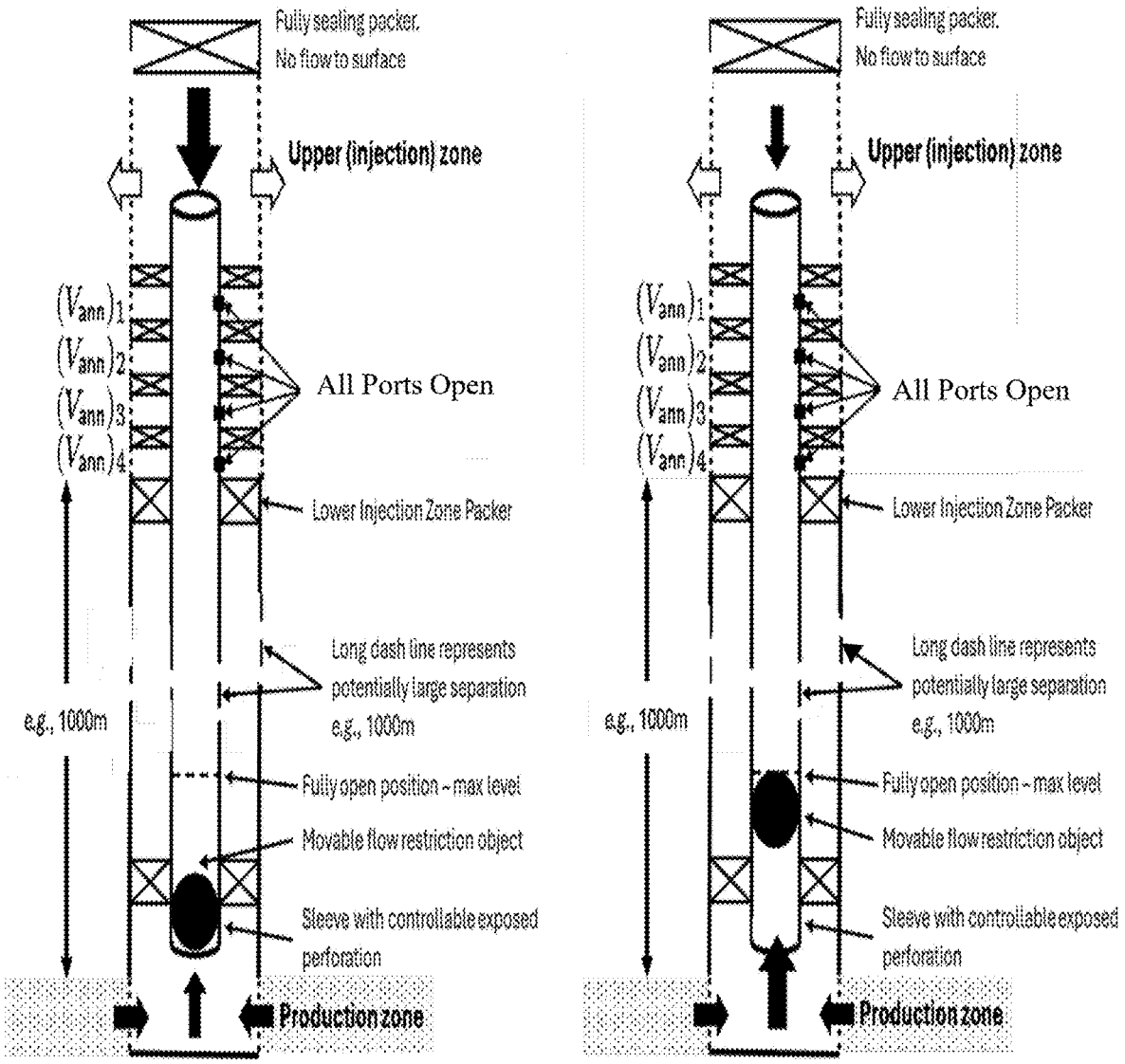
FIG. 7 illustrates the controllable sleeve based on pressure.
Figure 8:
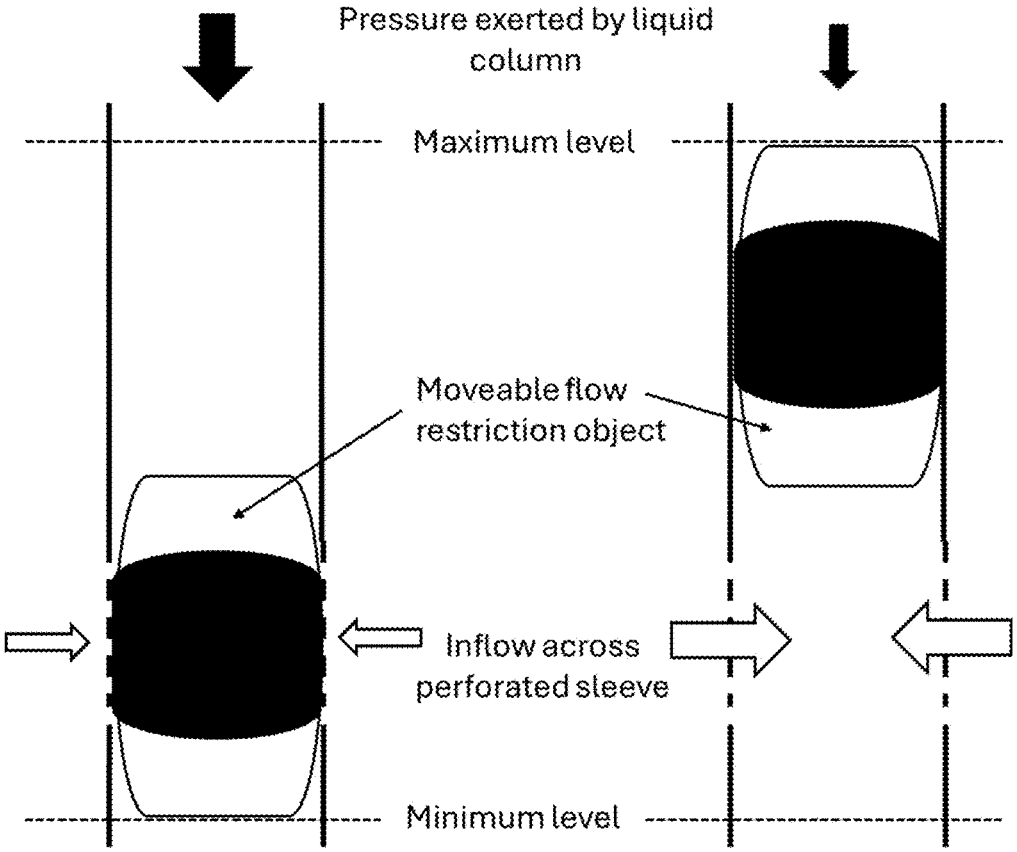
FIG. 8 illustrates the controllable sleeve.

Finally, concepts may be extended to include a sleeve or cap at the exit point of the production tubing in the injection zone that is triggered and adjusted as a function of height of the liquid column above (see FIGS. 7-8). The aspects described may be considered as a contingency or "back-up" arrangement in addition to controlling the perforation area exposed by the sleeve. The variable annular volume concept may, however, be possible as a stand-alone contingency mechanism for controlling and mitigating liquid level instabilities.

Referring to FIG. 7, when the pressure exerted by the liquid column rises, the movable flow restriction object (shown as a circle) will be forced downwards to the minimum flow level. Conversely, when the pressure exerted is low, the pressure from the producing zone will push the movable flow restriction object to the maximum flow level. The controllable sleeve with exposed perforation can control the system to effectively manage the flow to the injection zone given the prevailing hydrostatic pressure. In this manner, the system can be tuned/designed to mitigate the undesirable effects stemming from liquid instability in the upper zone.

Referring to FIG. 8, the lower part of the well is shown as per FIG. 7. When the pressure exerted by the liquid column is high, the movable flow restriction object is forced down (covering the exposed perforation on the sleeve) to give the minimum flow level. Conversely, when the pressure exerted is low, the movable flow restriction object rises upwards exposing the perforated sleeve to yield the maximum flow level and lowest pressure drop across the sleeve assembly. Note that the sleeve may be adjusted to control the total perforated area made available. In this manner, the system may be tuned/designed to mitigate liquid instability given the anticipated hydrostatic pressure in the injection zone. The adjustable volume concept provides an additional level of control to manage liquid instability in the upper injection zone.

In another embodiment, a concept is described for accurate analysis and computation of wellbore pressures necessary to open/close or change the orifice size of a variable choke valve in a dynamic multiphase flow (MPF) simulator. The purpose is to specify novel configuration-specific control and modeling functionalities that permit modeling of the autonomous liquid-phase hydrostatic head-driven inflow control valve [labelled (X) in FIG. 9] and the autonomous liquid-phase hydrostatic head-driven open/close valve [labelled (Y) in FIG. 9] that enables inflow of liquid into redundant annular volumes (see FIG. 9).

Figure 9:
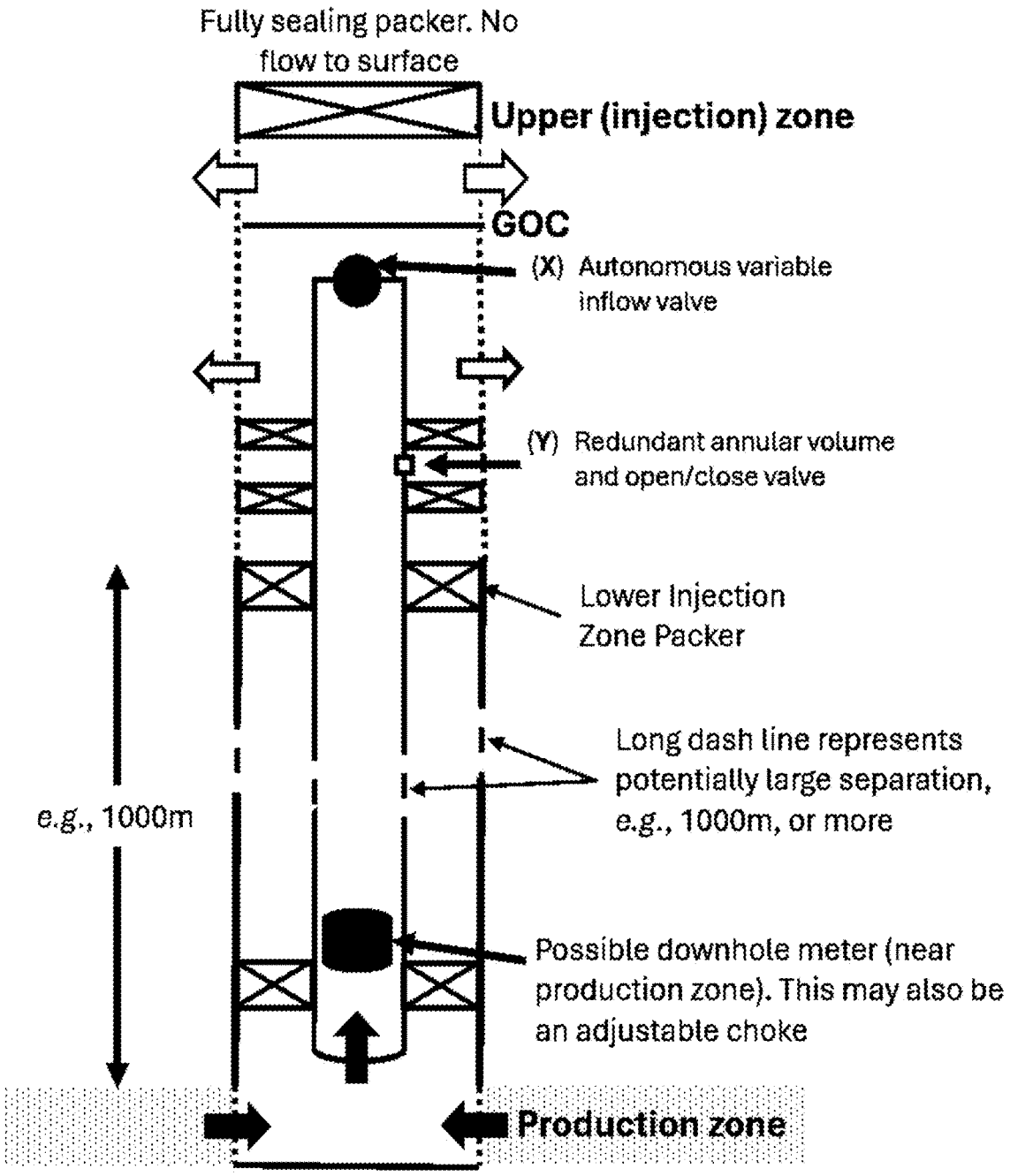
FIG. 9 illustrates the concept of the flowing system with cross-flow between a lower production zone and an upper injection zone.

FIG. 9 illustrates the proposed concept and indicates the cross-flow being promoted. The flowing system is essentially isolated in that no flow reaches surface. The system comprises a (lower) production zone and an (upper) injection zone higher up the well. In this example the bottom of the injection zone is about 1000 m [total vertical depth] above the top of the production zone. While packers isolate the production and injection zones, they are connected via a production tubing. FIG. 9 shows an autonomous hydrostatically-controlled inflow control valve [labelled (X)] in addition to one (or more) open/closed valves associated with activation of extra annular volumes [labelled (Y)].

FIG. 10 shows a schematic of the injection zone (an enlargement of upper section of FIG. 1). The FIG. shows the autonomous hydrostatically-controlled inflow control valve (X) as the circle, but does not show the valve (Y). The FIG. marks various (vertical) heights $h_v$ at several locations (labelled [1], [2], [3], m & n). The vertical height is specified for a single fluid phase p. Thus, height $h_v$, for single gas phase is denoted between points [1-2] and the liquid head is referenced at point [2] the gas-oil contact (GOC).

FIG. 11 shows the basic expressions necessary to activate these valves. While these basic expressions are already embedded in the dynamic multiphase flow (MPF) simulator, their application in a closed-system specifically designed to manage cross-flow (necessary for zero-emission clean-up) has not been explicitly defined. A facet of this disclosure is the explicit coupling of these expressions with orifice size and/or valve open/close choices. The dynamic MPF simulation is able to explicitly define the heights of not only the GOC, but also arbitrary points in the system reflecting chosen locations of the aforementioned valves and ports. The model is also able to mimic liquid level instability if the in situ conditions result in such. The autonomous (and manual) adjustment of valves and ports (as necessary) should then be enabled within the dynamic MPF simulation.

This coupling may be enabled in each solution time-step, where the stability is tightly coupled to the well-reservoir inflow into the injection zone as well as inflow into the wellbore from the lower production zone. Tight coupling of the well to porous media is embedded in the code.

For a variable valve (where orifice area $A_c$, can vary from closed to fully open), we define a relationship with pressure, where $A_c$ is assumed known (as per label [X] in FIG. 9). Similarly, we assume knowledge of pressure necessary to open/close the ports (per label [Y] in FIG. 9) as noted in the disclosure concerning redundant annular volumes.

Finally, this disclosure provides that the simulator has the ability to define the system configuration to reflect in situ conduit geometries of a closed producer-injector system required for zero-emissions, as shown in FIG. 9. The ability to initialize, or arbitrarily invoke, such a system at run-time is suggested. The upper isolation packer/valve could be opened or closed (at will), and if closed, it can be ensured the closed system is properly posed for liquid level and tightly coupled to the injection zone porous media.

Example embodiments of the claims are recited next. The recited example embodiments should not be considered limiting. In one example embodiment, a method to mitigate wellbore instabilities is disclosed. The method may comprise determining a presence, in a first portion of a wellbore of a production zone. The method may further comprise establishing an injection zone in a second portion of the wellbore. The method may further comprise cross-connecting the production zone and the injection zone through use of a production tubing that contains a choke and a flowmeter. The method may further comprise achieving a natural flow from the production zone to the injection zone through the production tubing, wherein a first end of the production tubing is placed in relation to the second end, such that a hydrostatic head of a liquid phase is sufficient to open and close a pressure arrangement. The method may further comprise monitoring a flow of fluids between the cross-connected production zone and the injection zone. The method may further comprise continually identifying a prevailing liquid column within the injection zone. The method may further comprise actuating the choke based upon the monitoring of the flow of fluids between the cross-connected production zone and the injection zone to reduce wellbore instabilities, the actuation taking into account the prevailing liquid column within the injection zone.

In another example embodiment, the method may be performed wherein achieving the natural flow from the production zone to the injection zone is through a pressure difference between the production zone and the injection zone.

In another example embodiment, the method may further comprise sealing the first portion of the wellbore with at least one packer.

In another example embodiment, the method may further comprise sealing the second portion of the wellbore with at least one packer.

In another example embodiment, the method may be performed wherein the pressure arrangement is opened and closed through hydraulic cabling.

In another example embodiment, the method may be performed wherein the pressure arrangement is opened and closed through electric cabling.

In another example embodiment, the method may be performed wherein the actuating the choke is performed autonomously.

In another example embodiment, a device for varying flow in a wellbore is disclosed. The device may comprise a pipe having a first fluid receiving end and a second ejecting end. The device may also comprise a valve configured to open and close positioned at the second ejecting end. The device may also comprise a restriction arrangement connected to the valve at the second ejecting end of the pipe, wherein the arrangement is configured to autonomously control a position of the valve based upon a liquid level height above the second ejecting end.

In another example embodiment, the device is configured wherein the restriction arrangement is a cap.

In another example embodiment, the device is configured wherein the restriction arrangement is a movable sleeve.

In one example embodiment, a method for controlling a volume in an injection zone of a hydrocarbon field is disclosed. The method may comprise cross-connecting a production zone and an injection zone and achieving a natural flow from the production zone to the injection zone through the cross-connection of the production zone and the injection zone; production tubing, such that a hydrostatic head of a liquid phase is sufficient to open and close a pressure arrangement placed within the cross-connection. The method may further comprise actuating a choke in the cross-connection based upon the head.

In another example embodiment, the method may be performed wherein the cross-connecting is accomplished through production tubing.

In another example embodiment, the method may further comprise monitoring a flow of fluids between the cross-connected production zone and the injection zone.

In another example embodiment, the method may further comprise continually identifying a prevailing liquid column within the injection zone.

In another example embodiment, the method may further comprise monitoring of the flow of fluids between the cross-connected production zone and the injection zone.

In another example embodiment, the method may be performed wherein the choke is at least one valve.

In another example embodiment, the method may further comprise monitoring the method for controlling the volume at a surface elevation.

In another example embodiment, the method may be performed wherein the actuating of the choke is performed through an autonomous action.

In another example embodiment, the method may be performed wherein the choke is performed through a cap moving on a pipe.

In another example embodiment, the method may be performed wherein the choke is performed through a sliding sleeve on a pipe.

Language of degree used herein, such as the terms "approximately", "about", "generally", and "substantially" as used herein represent a value, amount, or characteristic close to the stated value, amount, or characteristic that still performs a desired function or achieves a desired result. For example, the terms "approximately", "about", "generally", and "substantially", may refer to an amount that is within less than 10 percent of, within less than 5 percent of, within less than 1 percent of, within less than 0.1 percent of, and/or within less than 0.01 percent of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A method to mitigate wellbore instabilities, comprising:

determining a presence of a production zone in a first portion of a wellbore;

establishing an injection zone in a second portion of the wellbore;

cross-connecting the production zone and the injection zone through use of a production tubing that contains a choke;

achieving a natural flow of a wellbore fluid from the production zone to the injection zone through the production tubing, wherein a first end of the production tubing is placed in relation to a second end, such that a hydrostatic head of a liquid phase of the wellbore fluid is sufficient to open and close the choke;

and autonomously actuating the choke based upon the flow of the wellbore fluids between the cross-connected production zone and the injection zone and the hydrostatic head of the liquid phase of the wellbore fluid to reduce wellbore instabilities.

2. The method according to claim 1, wherein achieving the natural flow from the production zone to the injection zone is through a pressure difference between the production zone and the injection zone.

3. The method according to claim 1, further comprising: sealing the first portion of the wellbore with at least one packer.

4. The method according to claim 3, further comprising: sealing the second portion of the wellbore with at least one packer.

5. The method according to claim 1, wherein the production tubing contains a flowmeter and further comprising monitoring a flow of fluids between the cross-connected production zone and the injection zone with the flowmeter.

6. A method for controlling a volume in an injection zone of a hydrocarbon field; comprising:

cross-connecting a production zone and an injection zone in the hydrocarbon field;

achieving a natural flow of hydrocarbon fluids from the production zone to the injection zone through the cross-connection of the production zone and the injection zone such that a hydrostatic head of the liquid phase is sufficient to open and close a choke placed within the cross-connection; and autonomously actuating the choke in the cross-connection based upon the hydrostatic head.

7. The method according to claim 6, wherein the cross-connection comprises production tubing.

8. The method according to claim 6, further comprising monitoring a flow of the hydrocarbon fluids between the cross-connected production zone and the injection zone.

9. The method according to claim 8, further comprising continually identifying a prevailing liquid column within the injection zone.

10. The method according to claim 9, further comprising monitoring of the flow of the hydrocarbon fluids between the cross-connected production zone and the injection zone.

11. The method according to claim 8, wherein monitoring comprises monitoring with a flowmeter disposed in the production tubing.

12. The method according to claim 6, wherein the choke comprises at least one valve.

13. The method according to claim 6, wherein the choke comprises a cap moving on a pipe.

14. The method according to claim 6, wherein the choke comprises a sliding sleeve on a pipe.

* * * * *